US008881641B2

(12) United States Patent
Nagler

(10) Patent No.: US 8,881,641 B2
(45) Date of Patent: Nov. 11, 2014

(54) FLUID PRESSURE DRIVEN MOTOR WITH PRESSURE COMPENSATION CHAMBER

(76) Inventor: Ehud Nagler, Kiryat Tivon (IL)

( * ) Notice: Subject to any disclaimer, the term of this patent is extended or adjusted under 35 U.S.C. 154(b) by 599 days.

(21) Appl. No.: 13/275,356

(22) Filed: Oct. 18, 2011

(65) Prior Publication Data

US 2013/0092020 A1 Apr. 18, 2013

(51) Int. Cl.
*F15B 13/04* (2006.01)
*F04B 1/02* (2006.01)

(52) U.S. Cl.
CPC ..... *F04B 1/02* (2013.01)
USPC ..... 91/185; 91/288; 91/315

(58) Field of Classification Search
CPC ..... F04B 1/02
USPC ..... 91/176, 185, 286, 288, 315, 352; 251/283; 277/583, 605, 645
See application file for complete search history.

(56) References Cited

U.S. PATENT DOCUMENTS 7,258,057 B2 * 8/2007 Nagler et al. ..... 91/185

* cited by examiner

*Primary Examiner* — Ned Landrum
*Assistant Examiner* — Logan Kraft
(74) *Attorney, Agent, or Firm* — Mark M. Friedman

(57) ABSTRACT

A fluid-driven motor has a manifold with an arcuate seal including first and second valve openings and a sealing surface. A cylinder pivotally mounted on the manifold has a facing surface cooperating with the arcuate seal. The arcuate seal and the facing surface define a position-responsive valve configuration such that, when the cylinder assumes a neutral position, an aperture of the facing surface faces the sealing surface, and when the cylinder is angularly displaced in either direction, the aperture overlaps one or other of the valve openings, thereby connecting to the correspond fluid flow channel in the manifold. A pressure compensation volume underlies the sealing surface and receives fluid pressure from the fluid flow channels through valves, or from the internal volume of the cylinder, so that a pressure within the pressure compensation volume approaches a value no less than a current pressure within the internal volume.

11 Claims, 13 Drawing Sheets

FLUID PRESSURE DRIVEN MOTOR WITH PRESSURE COMPENSATION CHAMBER

FIELD AND BACKGROUND OF THE INVENTION

The present invention relates to fluid pressure driven motors and, in particular, it concerns a bidirectional fluid pressure driven piston motor with a pressure compensation chamber.

U.S. Pat. No. 7,258,057 teaches various implementations of a water-driven piston motor. Referring particularly to FIGS. 14 and 15 thereof, which are reproduced here as FIGS. 1A and 1B, respectively, and referring to original reference numerals in parentheses, there is shown an assembly in which a cylinder (13) is mounted rotatably on a valve body (45). The cylinder has a central opening which selectively overlaps with one or other of two apertures (38), (39) as a function of the angle of the cylinder. When fluid pressure is delivered to channel (113) and channel (114) is open to drain, the cylinder opening overlaps aperture (38) while deflected to angles right-of-center, resulting in a driving pressure acting to extend piston (100) on the right half of a crankshaft motion. When the cylinder reaches center-bottom, the cylinder opening no longer overlaps aperture (38) and, as the cylinder continues to left-of-center, the opening starts to overlap aperture (39), thereby allowing draining of the cylinder contents to channel (114) during the left half of the crankshaft motion. By providing three or more cylinders out of phase, it is possible to ensure that at least one is effective to provide a driving torque to the crankshaft at any moment. By providing fluid pressure to channel (114) and opening channel (113) to drain, motion can be driven in a reverse direction of rotation.

As shown in FIG. 1B (original FIG. 15), in order to minimize leakage from the pressurized input channel into the cylinder during the part of the cycle in which the pressure-supplying aperture is sealed, each aperture is provided with a seal configuration which includes an elastomeric sleeve (107), (111) which biases a thin cap or hard sealing material (108), (112) to conform against the cylindrical inner surface of the cylinder head.

SUMMARY OF THE INVENTION

The present invention is a fluid driven motor.

According to the teachings of the present invention there is provided, a fluid-driven motor comprising: (a) a manifold including a first fluid flow channel and a second fluid flow channel, the manifold providing an arcuate seal defining: (i) a first valve opening in fluid connection with the first fluid flow channel, (ii) a second valve opening in fluid connection with the second fluid flow channel, and (iii) at least one sealing surface; (b) a cylinder having a cylinder head mounted pivotally on the manifold, the cylinder head being providing a facing surface configured to cooperate with the arcuate seal, the facing surface having at least one aperture; and (c) a piston deployed within the cylinder so as to be driven to extend by pressure of a fluid introduced to an internal volume of the cylinder, wherein the arcuate seal and the facing surface cooperate to define a position-responsive valve configuration such that, when the cylinder assumes a neutral position, the at least one aperture is in facing relation with the at least one sealing surface, when the cylinder is angularly displaced in a first direction from the neutral position, the at least one aperture overlaps the first valve opening such that the internal volume of the cylinder is in fluid connection with the first fluid flow channel, and when the cylinder is angularly displaced in a second direction from the neutral position, the at least one aperture overlaps the second valve opening such that the internal volume of the cylinder is in fluid connection with the second fluid flow channel, wherein the manifold further comprises a pressure compensation volume underlying at least part of the at least one sealing surface, the pressure compensation volume being interconnected with at least one of the first flow channel, the second flow channel and the internal volume of the cylinder in such a manner that a pressure within the pressure compensation volume approaches a value no less than a current pressure within the internal volume.

According to a further feature of an embodiment of the present invention, the pressure compensation volume is interconnected via one-way valves so as to receive fluid pressure from both the first flow channel and the second flow channel.

According to a further feature of an embodiment of the present invention, the pressure compensation volume is at least partially delimited by an elastomer element, the elastomer element forming at least part of the one-way valves.

According to a further feature of an embodiment of the present invention, the elastomer element is configured to bias the seal into contact with the facing surface of the cylinder head.

According to a further feature of an embodiment of the present invention, the pressure compensation volume is interconnected with the internal volume of the cylinder via a pressure equalization aperture formed in the seal.

According to a further feature of an embodiment of the present invention, the cylinder is one of a plurality of similar cylinders, and the piston is one of a plurality of similar pistons, the pistons being connected in driving relation to a common crankshaft.

According to a further feature of an embodiment of the present invention, there is also provided a control valve arrangement selectively assuming: (a) a first state in which the control valve arrangement connects the first flow channel to a source of water pressure and the second flow channel to a drainage line for driving the fluid driven motor in a first direction; and (b) a second state in which the control valve arrangement connects the second flow channel to a source of water pressure and the first flow channel to a drainage line for driving the fluid driven motor in a direction opposite to the first direction.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a bidirectional fluid driven piston motor.

The principles and operation of fluid driven motors according to the present invention may be better understood with reference to the drawings and the accompanying description.

By way of introduction, the present invention relates primarily to fluid driven motors suitable for low cost mass production, and in particular, formed primarily or exclusively from polymer materials that are typically injection molded. The motors of the present invention are typically configured to operate with fluids such as water pressure or air pressure in the range of commonly available domestic or industrial supplies, such as in the range of 2-10 atmospheres. Such devices rely upon arrangements of dynamic seals to prevent leakage between the relatively low precision components.

Figure 1A:
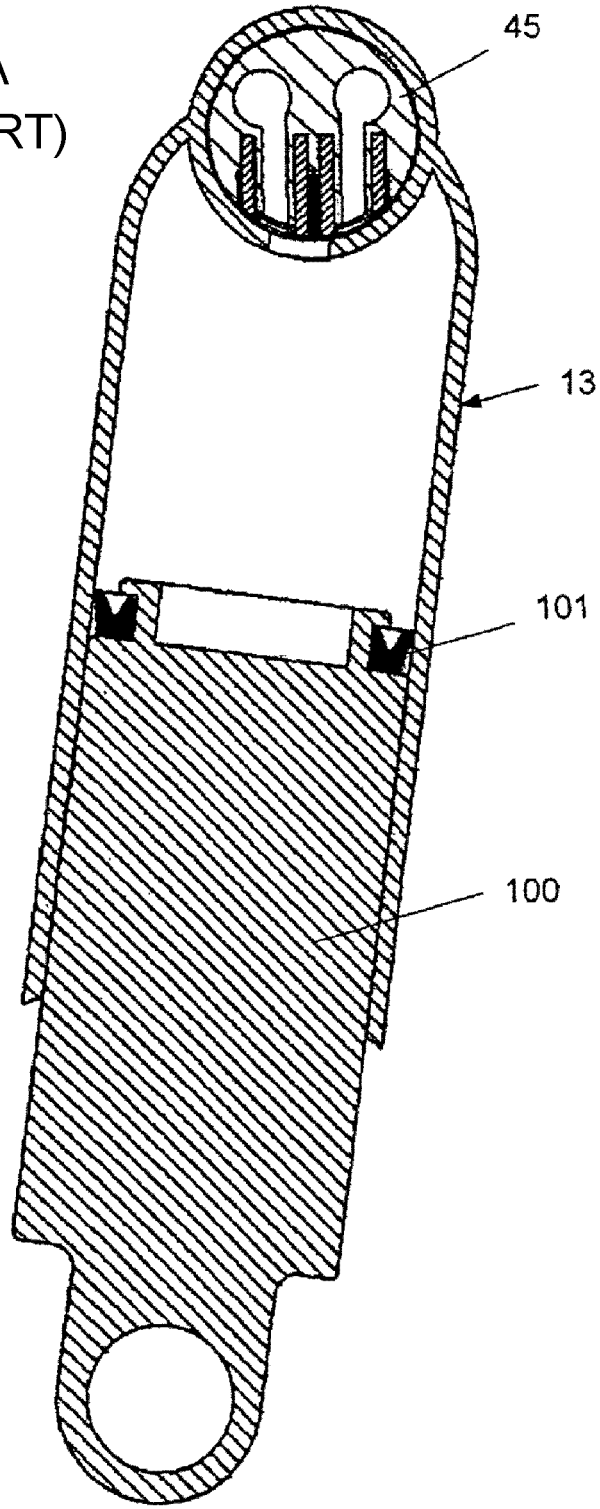
FIG. 1A (PRIOR ART)
FIGS. 1A and 1B, discussed above, are reproductions of FIGS. 14 and 15, respectively, of U.S. Pat. No. 7,258,057.
Figure 1B:
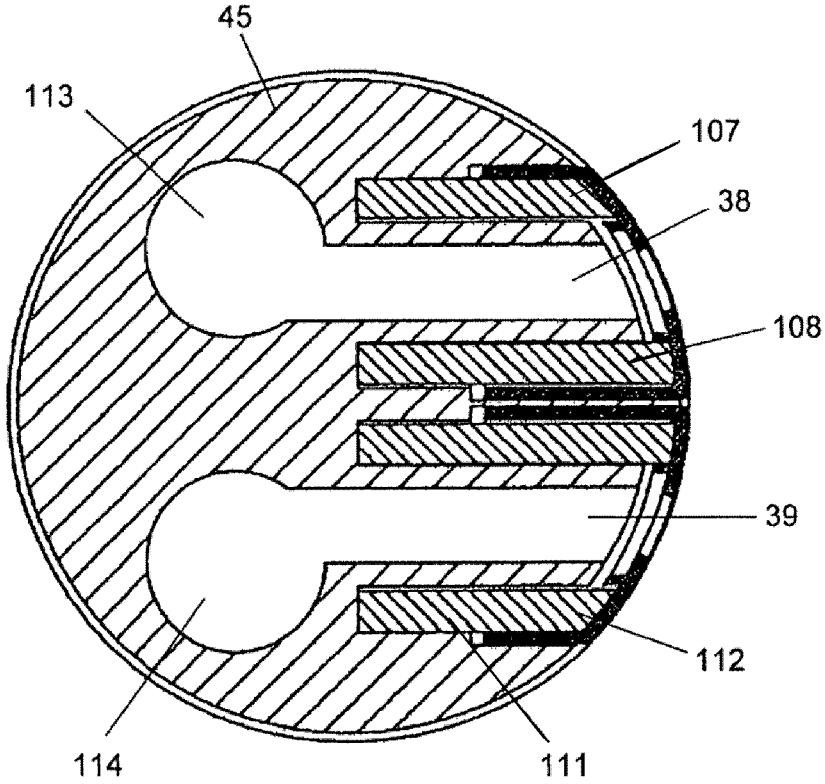
FIG. 1B (PRIOR ART)
Figure 2:
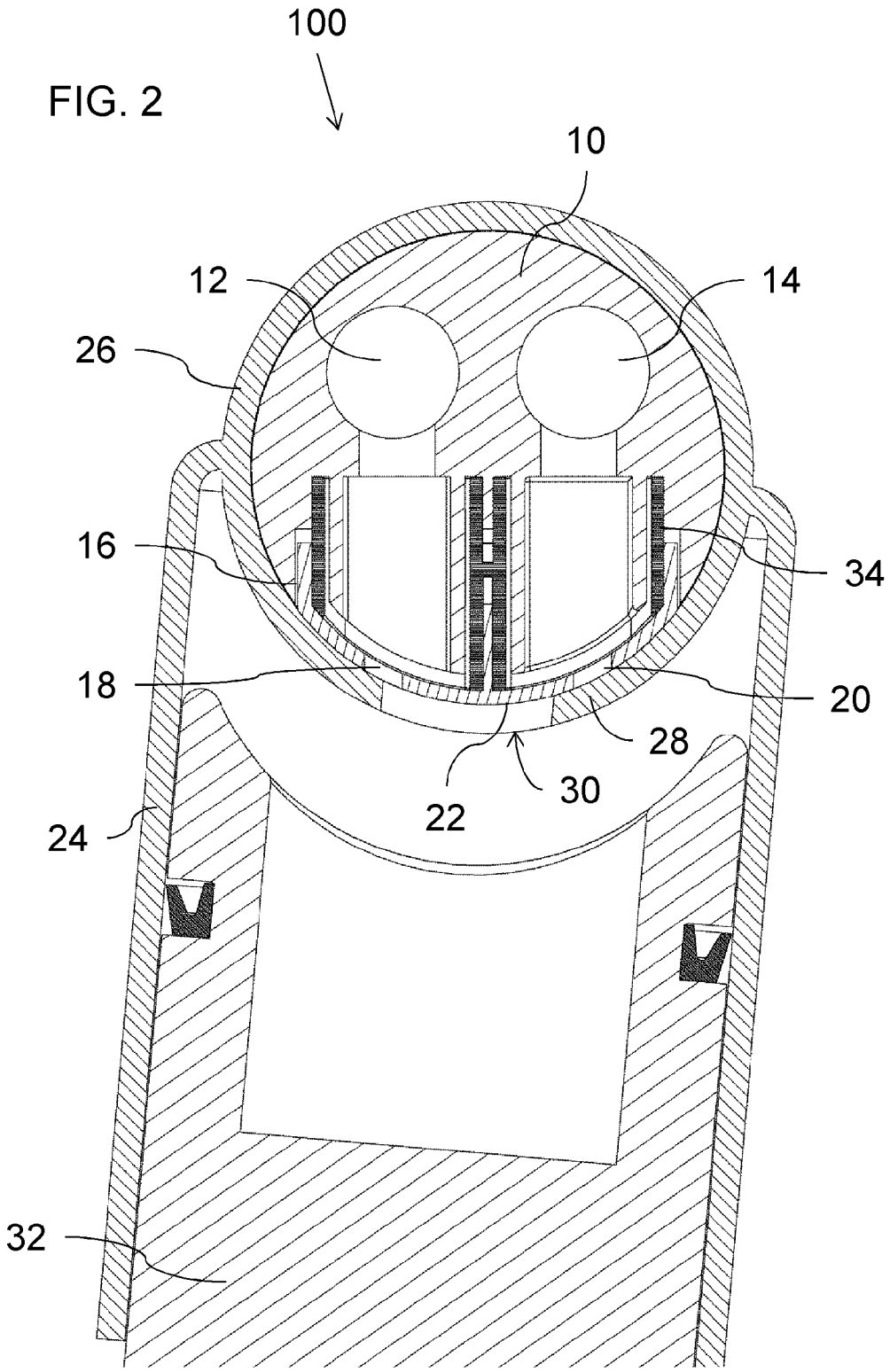
FIG. 2 is a schematic cross-sectional view taken through a modified implementation of a cylinder from a fluid driven motor similar to FIG. 1A.

FIG. 2 shows a cross-sectional view taken through a bidirectional motor, generally designated 100, corresponding to a somewhat modified version of the design of U.S. Pat. No. 7,258,057 described above. Introducing nomenclature which will be maintained throughout this document for equivalent features, bidirectional motor 100 includes a manifold 10 including a first fluid flow channel 12 and a second fluid flow channel 14. Manifold 10 provides an arcuate seal 16 defining a first valve opening 18 in fluid connection with fluid flow channel 12, a second valve opening 20 in fluid connection with fluid flow channel 14, and at least one sealing surface 22. A cylinder 24 has a cylinder head 26 mounted pivotally on manifold 10 which provides a facing surface 28 configured to cooperate with arcuate seal 16. Facing surface 28 has at least one aperture 30. A piston 32 is deployed within cylinder 24 so as to be driven to extend by pressure of a fluid introduced to an internal volume of the cylinder.

Arcuate seal 16 and facing surface 28 cooperate to define a position-responsive valve configuration such that: when cylinder 24 assumes a neutral position, aperture 30 is in facing relation with sealing surface 22, when cylinder 24 is angularly displaced in a first direction from the neutral position, aperture 30 overlaps first valve opening 18 such that the internal volume of cylinder 24 is in fluid connection with fluid flow channel 12 (as shown in FIG. 2), and when cylinder 24 is angularly displaced in a second direction from the neutral position, aperture 30 overlaps second valve opening 20 such that the internal volume of cylinder 24 is in fluid connection with fluid flow channel 14. The sizes and positions of the openings are such that even a small movement to either side of the central position results in opening of one of the valve openings.

In the example illustrated in FIG. 2, an elastomer element 34 is configured to bias arcuate seal 16 to provide an initial contact pressure against facing surface 28. On the side of manifold 10 provided with the pressurized input flow, the pressure built up behind the arcuate seal tends to enhance the effectiveness of the seal. For example, considering the position shown in FIG. 2, if the fluid pressure supply is currently connected to flow channel 14, the pressure built up behind the regions of seal 16 adjacent to valve opening 20 tend to press the seal firmly against facing surface 28, thereby enhancing the seal.

It has been found, however, that a reduction in efficiency may occur in this structure due to incomplete sealing during the part of the cycle in which fluid pressure is delivered into the cylinder. To illustrate this point, if we consider the position of FIG. 2 in the case that fluid pressure is being supplied to flow channel 12 and flow channel 14 is connected to a fluid drainage line, it will be noted that the internal volume of cylinder 24 is exposed to the supply pressure which acts outwards on the exposed external surface of seal 16 (i.e., the surface facing outwards from manifold 10 toward the cylinder volume). In the region of seal 16 to the right of the centerline of the structure, the inward-facing surface of seal 16 (i.e., facing inwards towards manifold 10) is exposed only to the low pressure of the drainage line which does not provide support to oppose the high pressure within the cylinder. As a result, there is a tendency of seal 16 to flex slightly away from facing surface 28, allowing some degree of leakage to the outlet flow path during the drive stroke of the piston, with a consequent reduction in operational efficiency.

While it might in principle be possible to overcome this problem by increasing the constant resilient biasing of seal 16 against facing surface 28, it would be necessary to provide sufficient force to seal against the maximum design pressure limit for operation of the motor, for example, around 10 bar, which would lead to greatly increased frictional losses, with a corresponding reduction in operational efficiency.

Figure 9:
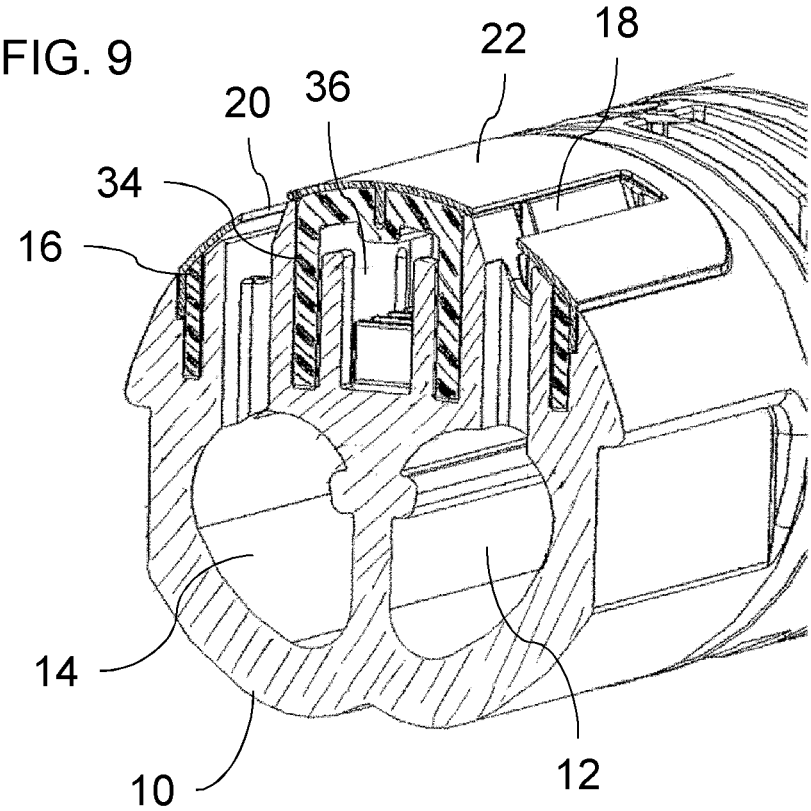
FIG. 9 is a cut-away assembled isometric view of the valve assembly of FIG. 6.
Figure 10A:
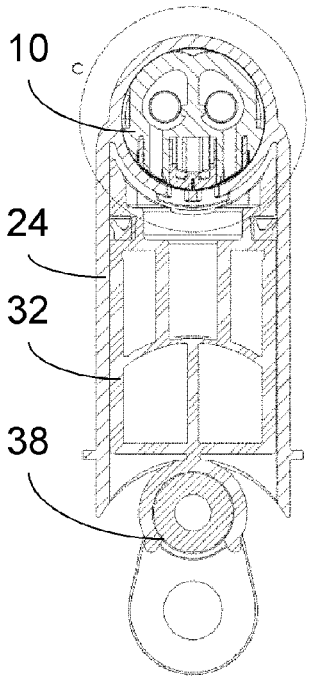
FIGS. 10A-10F are cross-sectional views taken through the fluid driven motor of FIG. 3 perpendicular to an extensional direction of the manifold, showing the cylinder and crankshaft in a number of successive positions during a cycle of motion.
Figure 10B:
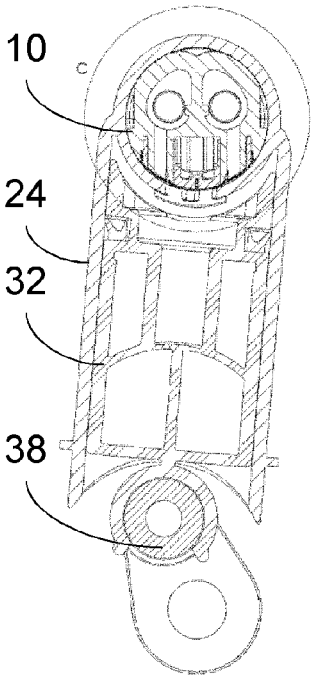
Figure 10C:
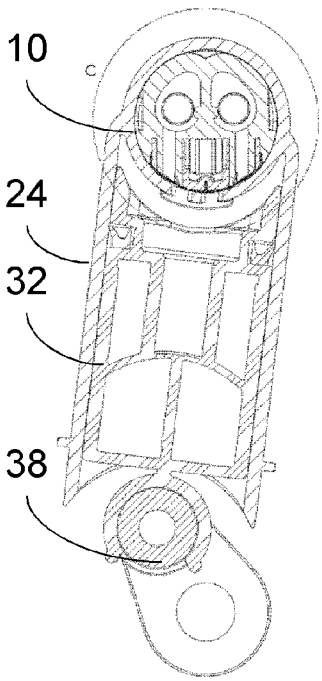
Figure 10D:
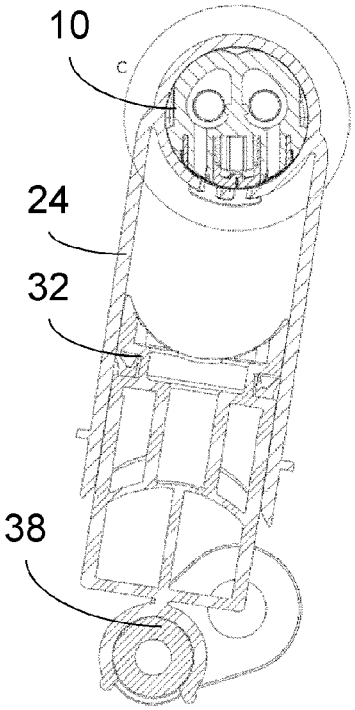
Figure 10E:
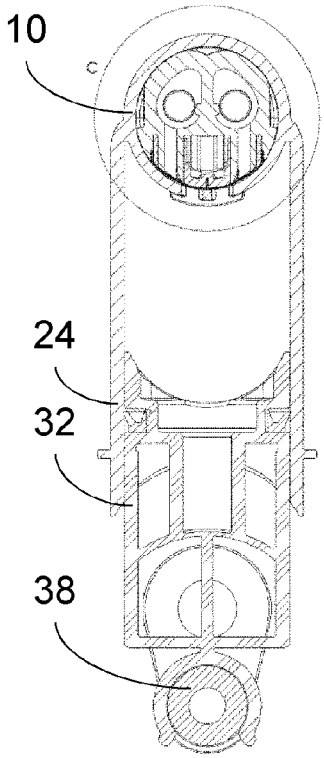
Figure 10F:
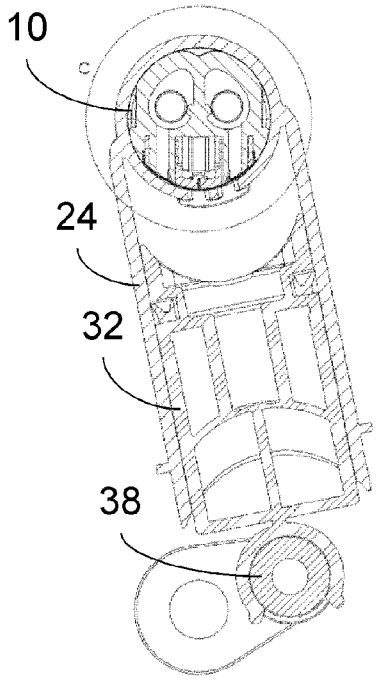
Figure 14:
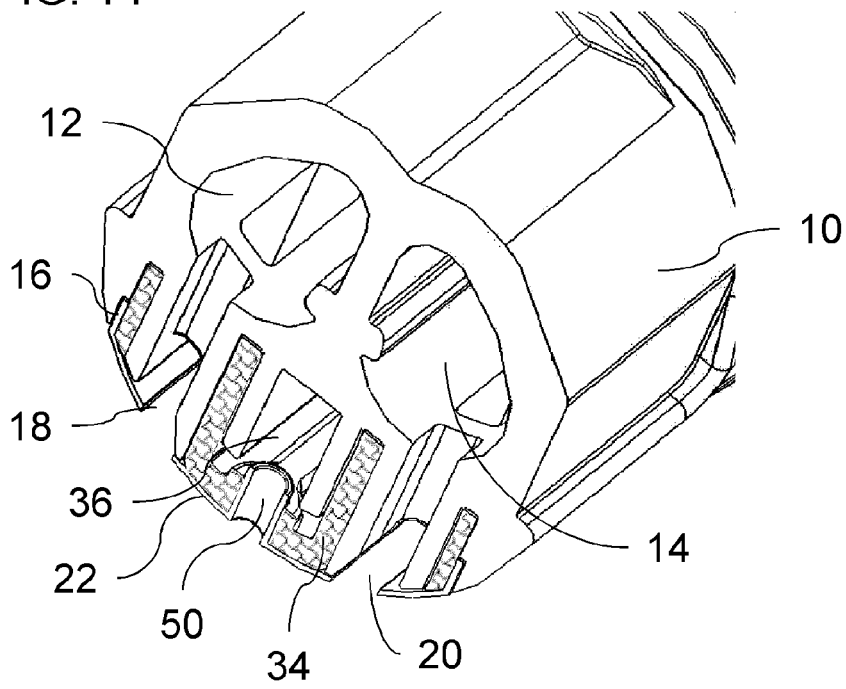
FIG. 14 is a cut-away assembled isometric view of the valve assembly of FIG. 12A.

As will be illustrated below, in order to address this issue, particularly preferred embodiments of the present invention provide a pressure compensation volume (chamber) 36 (FIGS. 9 and 14) underlying at least part of sealing surface 22 which is maintained at elevated pressure, at least during the part of the cycle in which cylinder 24 is exposed to high inlet pressure. This provides additional support to seal 16 in the critical region(s), thereby eliminating or greatly reducing the aforementioned leakage.

The aforementioned principles will be described below with reference to two non-limiting exemplary embodiments. A first exemplary embodiment of these principles will be described with reference to FIGS. 3-11D, while a second exemplary embodiment will be described with reference to FIGS. 12A-15B.

Figure 3:
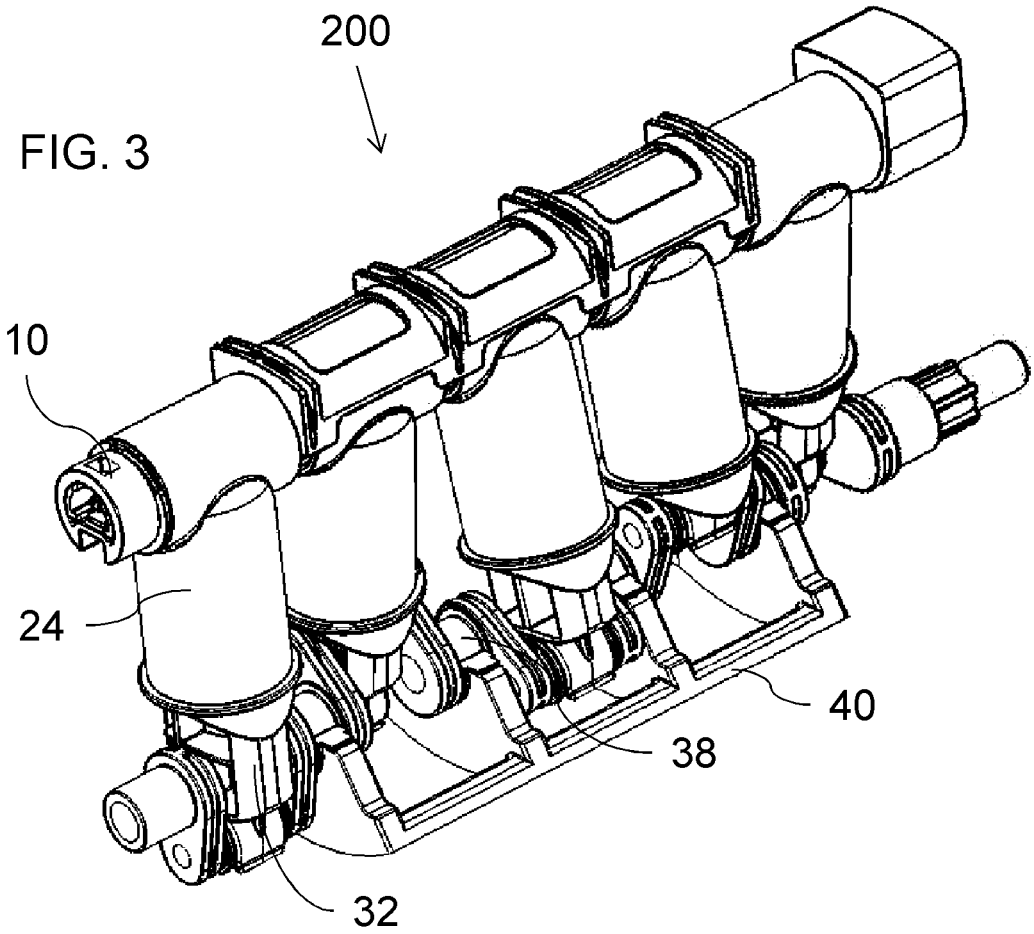
FIG. 3 is an isometric view of a fluid driven motor, constructed and operative according to an embodiment of the present invention.
Figure 4:
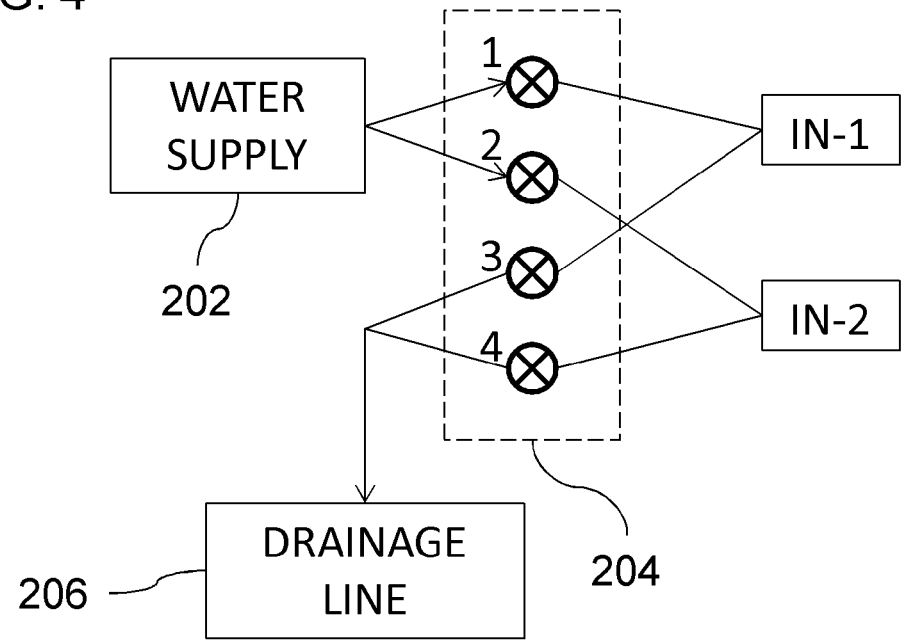
FIG. 4 is a schematic representation of a valve arrangement for use in driving the motor of FIG. 3 bidirectionally.
Figure 5:
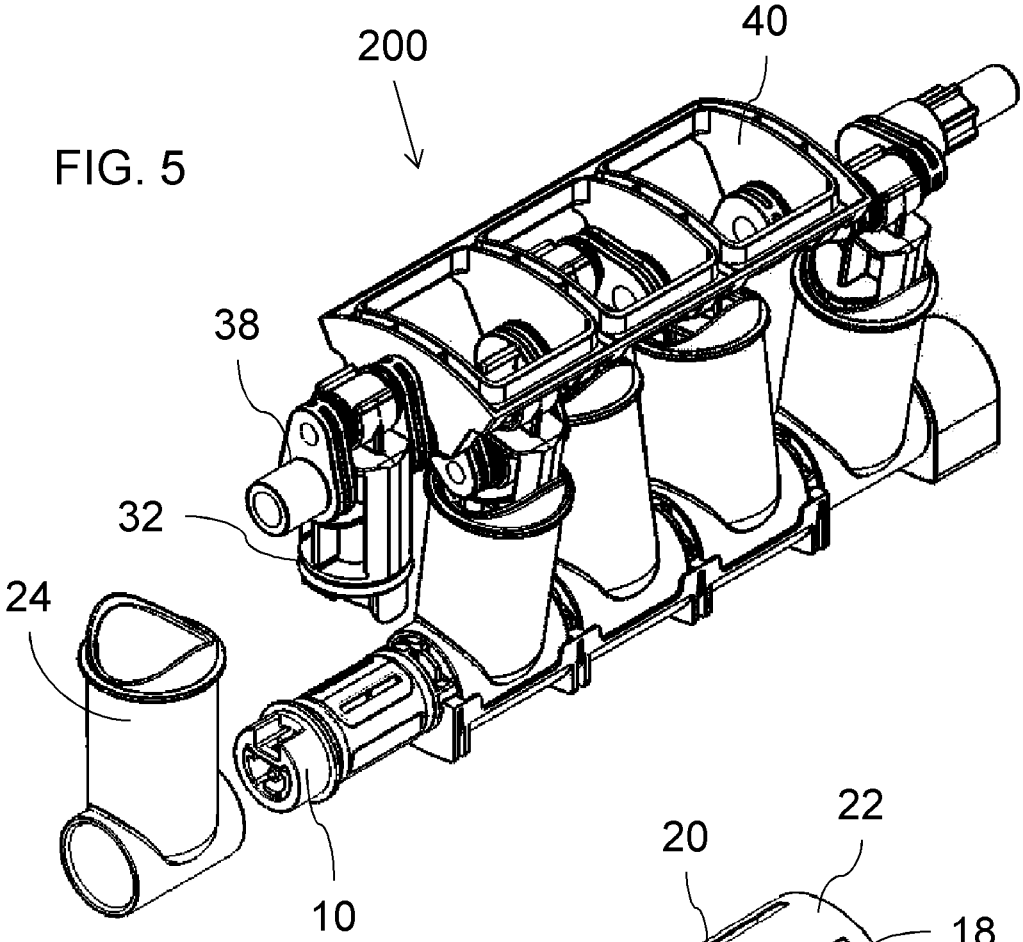
FIG. 5 is an inverted isometric view of the motor of FIG. 3 with one cylinder removed to reveal a part of a manifold.
Figure 6:
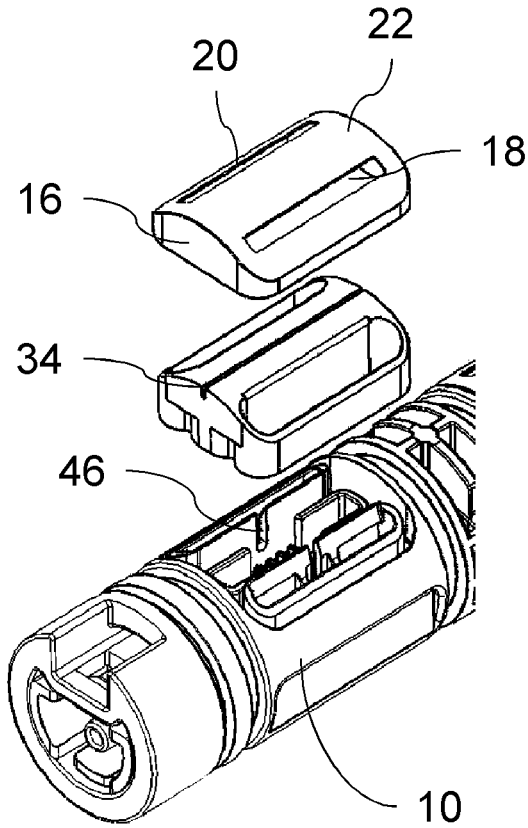
FIG. 6 is an enlarged and exploded view of the revealed region of the manifold from FIG. 5 illustrating components of a valve assembly.

Turning now to FIGS. 3-11D, there is shown a fluid pressure driven motor generally designated 200, constructed and operative according to an embodiment of the present invention. Motor 200 is generally similar to motor 100 of FIG. 2, and equivalent elements are designated by corresponding numerals. Thus, as shown in FIG. 3, motor 200 has a plurality of cylinders 24 having cylinder heads 26 mounted pivotally on manifold 10. Each cylinder 24 has a corresponding piston 32 linked to a common crank shaft 38 which is supported by a lower mount 40. A typical flow control arrangement for actuating motor 200 (and other embodiments of the present invention) is illustrated schematically in FIG. 4. A source of fluid pressure, such as a water supply 202, is connected via a valve arrangement 204 to inlets IN-1 and IN-2, which connect with fluid flow channels 12 and 14, respectively. Valve arrangement 204 also connects to a drainage line 206 which releases spent water to a drain. Valve arrangement 204 in the example shown here includes four valves, numbered 1-4. In a first drive state, valves 1 and 4 are open while valves 2 and 3 remain closed, thereby connecting pressurized water supply 202 to IN-1 and connecting IN-2 to drainage line 206. In a second drive state for driving the motor in the reverse direction, valves 2 and 3 are open while valves 1 and 4 remain closed, thereby connecting pressurized water supply 202 to IN-2 and connecting IN-1 to drainage line 206. It will be appreciated that the particular arrangement and number of valves used, as well as the type of actuation employed, may be varied according to the requirements of any given application.

As best seen in the various disassembled and cut-away views of FIGS. 5-9, manifold 10 includes a first fluid flow channel 12 and a second fluid flow channel 14. For each cylinder, manifold 10 provides an arcuate seal 16 defining a first valve opening 18 in fluid connection with fluid flow channel 12, a second valve opening 20 in fluid connection with fluid flow channel 14, and at least one sealing surface 22. Cylinder head 26 provides a facing surface 28 configured to cooperate with arcuate seal 16. Facing surface 28 has at least one aperture 30. A piston 32 is deployed within cylinder 24 so as to be driven to extend by pressure of a fluid introduced to an internal volume of the cylinder.

Arcuate seal 16 and facing surface 28 cooperate to define a position-responsive valve configuration such that: when cylinder 24 assumes a neutral position (center top position of FIGS. 10A and 11A, and center bottom position of FIGS. 10E and 11C), aperture 30 is in facing relation with sealing surface 22 so as to seal the internal volume of cylinder 24. When cylinder 24 is angularly displaced in a first direction from the neutral position, such as to the left as viewed in FIGS. 10B-10D and 11B, aperture 30 overlaps first valve opening 18 such that the internal volume of cylinder 24 is in fluid connection with fluid flow channel 12. When cylinder 24 is angularly displaced in a second direction from the neutral position, such as to the right as viewed in FIGS. 10F and 11D, aperture 30 overlaps second valve opening 20 such that the internal volume of cylinder 24 is in fluid connection with fluid flow channel 14. An elastomer element 34 is configured to bias arcuate seal 16 to provide an initial contact pressure against facing surface 28.

It is a particularly preferred feature of certain embodiments of the present invention that manifold 10 provides a pressure compensation volume 36 interconnected via one-way valves so as to receive fluid pressure from both first flow channel 12 and second flow channel 14. The combination of one-way valves is such that whichever of flow channels 12 and 14 is at a higher pressure forces fluid through the valve into pressure compensation volume 36, thereby raising the volume to the elevated supply pressure, while the second one-way valve resists escape of pressurized fluid to the lower-pressure flow channel. When the direction of operation of the motor is reversed, and the elevated supply pressure is switched to the other flow channel, volume 36 is again raised to the higher pressure of the input channel of pressurized fluid without allowing leakage through volume 36 to the lower pressure outlet/drainage channel. In this manner, volume 36 is consistently maintained at the elevated pressure of the pressurized fluid supply channel independent of the direction of motor operation.

Figure 11A:
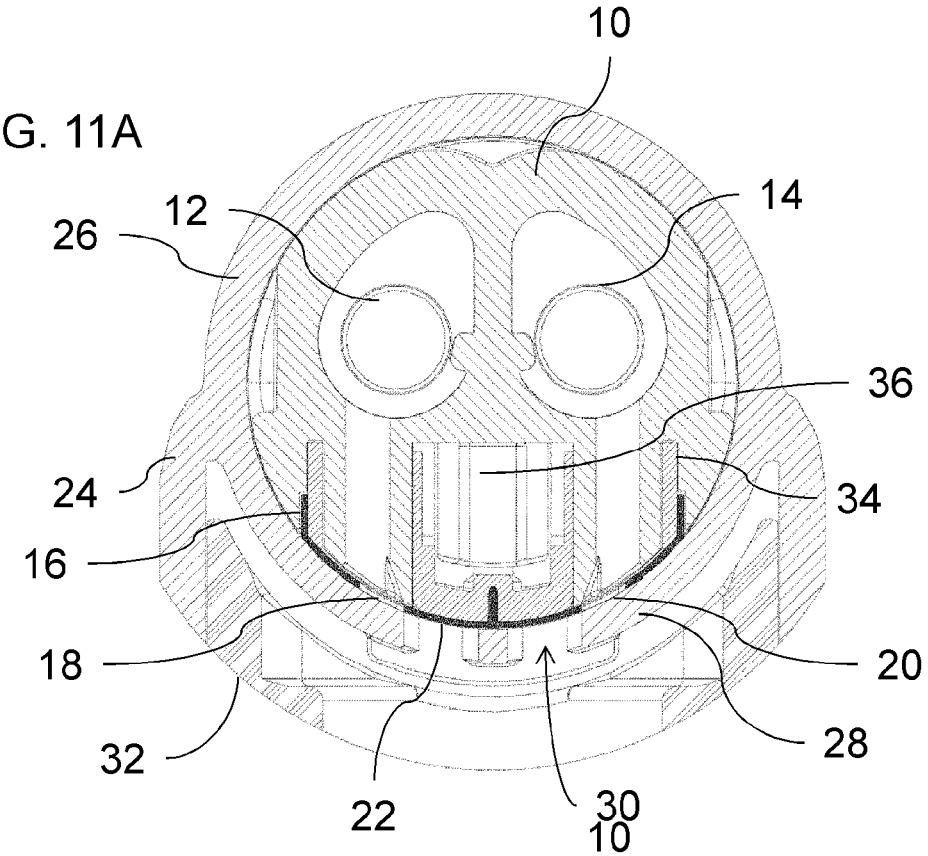
FIGS. 11A-11D are enlarged views of the regions of FIGS. 10A, 10C, 10E and 10F, respectively, designated by a circle "C"
Figure 11B:
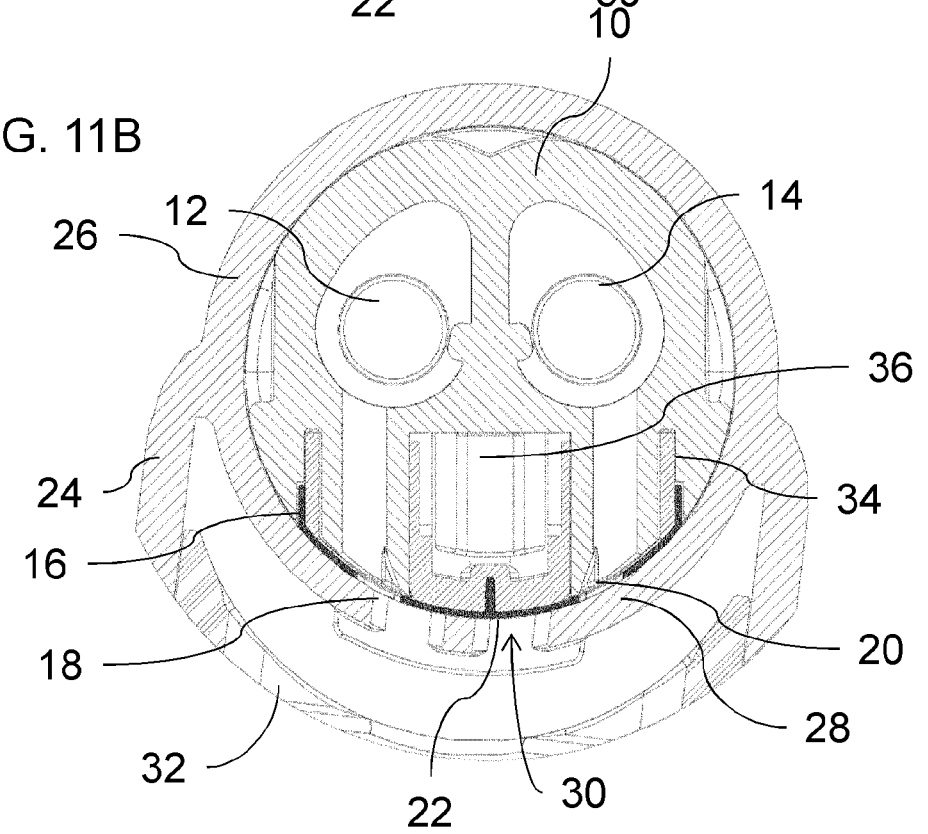
Figure 11C:
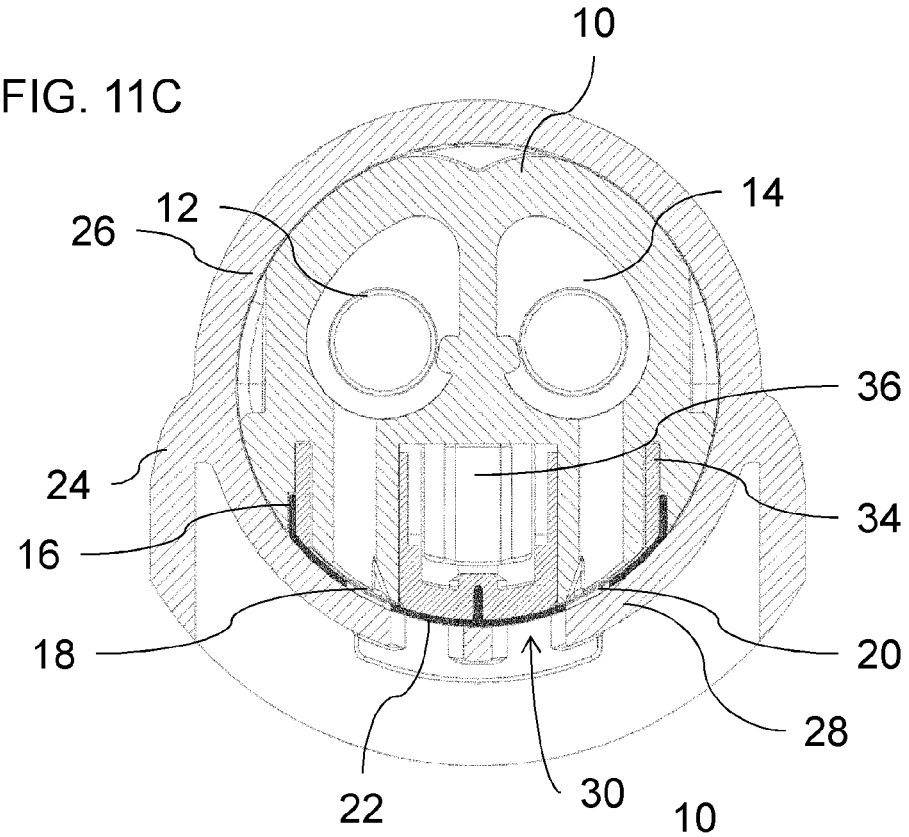
Figure 11D:
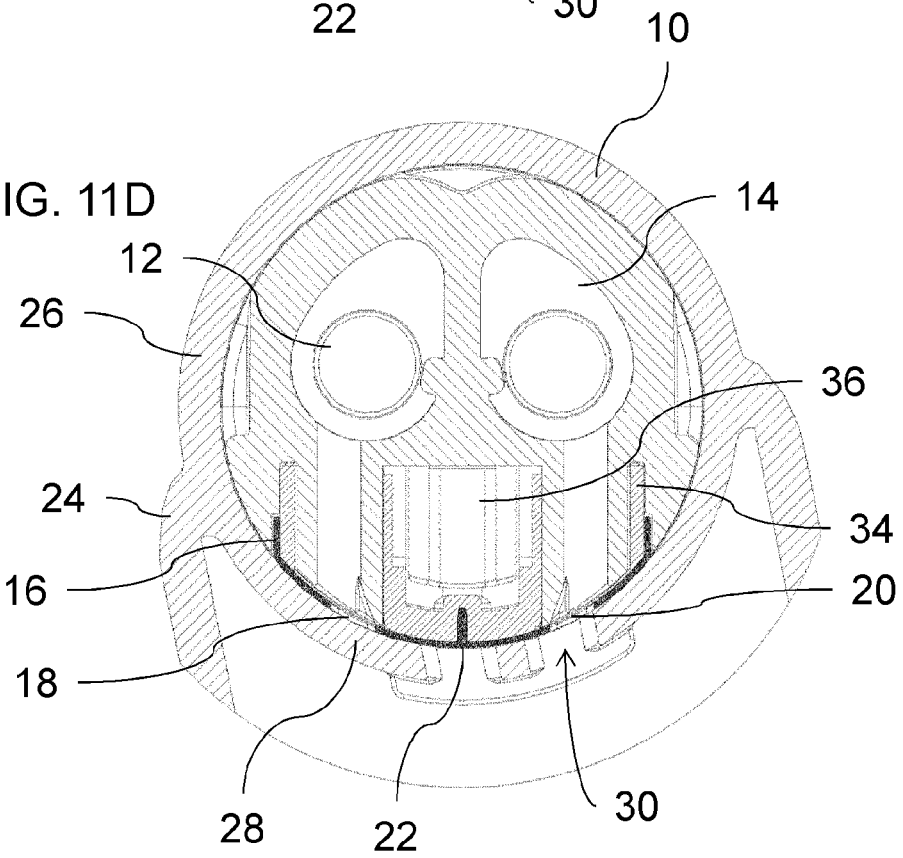
Figure 12A:
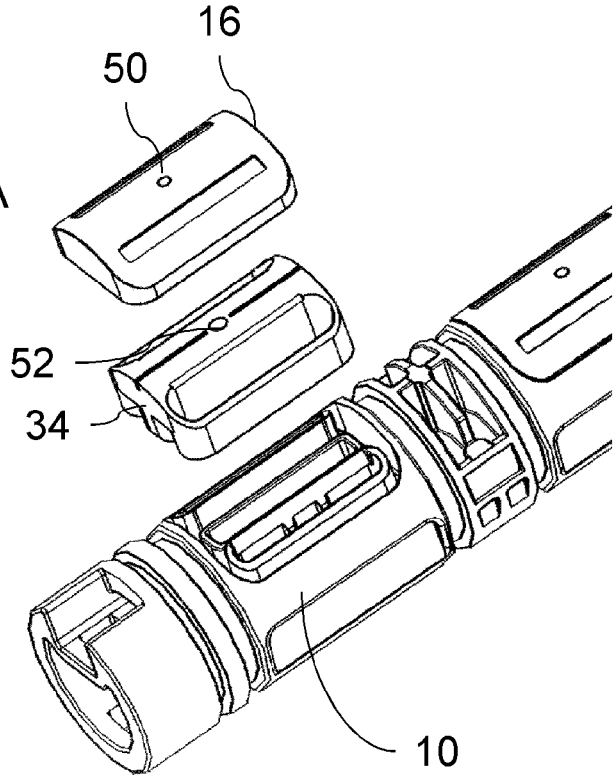
FIGS. 12A and 12B are upper and lower exploded isometric views similar to FIG. 6 illustrating an alternative implementation constructed and operative according to an embodiment of the present invention.
Figure 12B:
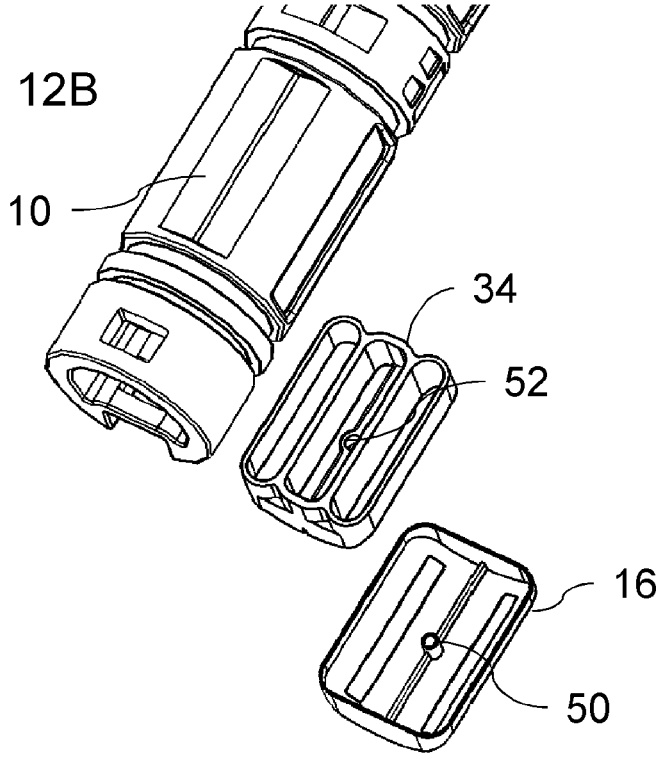
Figure 13:
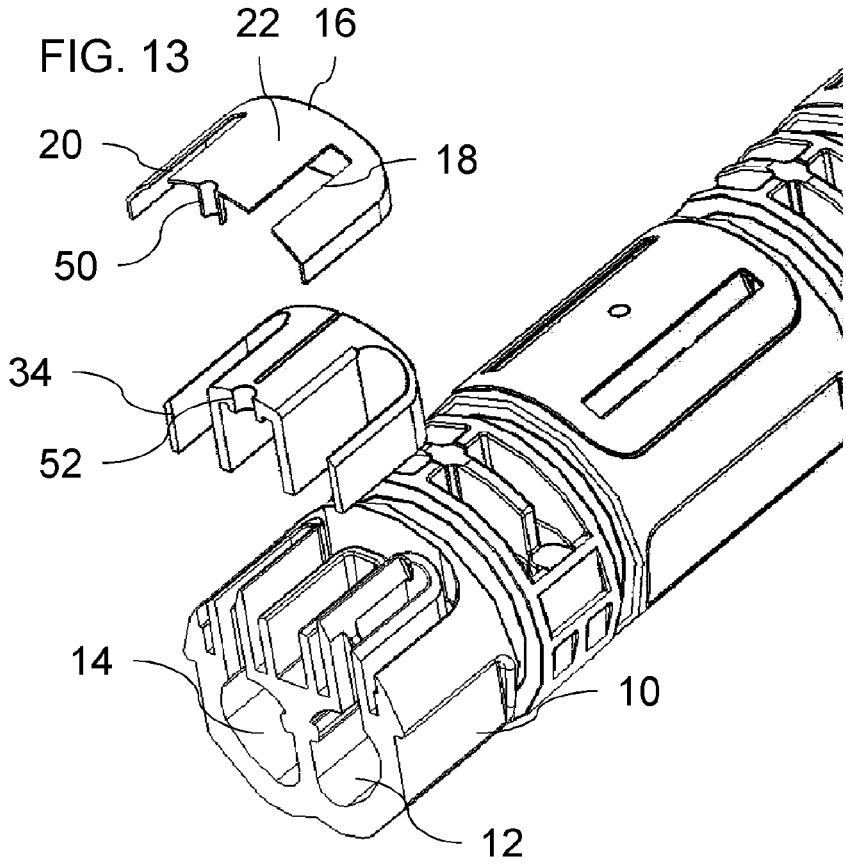
FIG. 13 is a cut-away exploded isometric view of the valve assembly of FIG. 12A.

The significance of pressure compensation volume 36 will be best appreciated with reference to FIG. 11B. If we assume a situation in which the driving fluid pressure is applied to fluid flow channel 12, FIG. 11B shows a stage near the beginning of the downward power stroke in which pressurized fluid is being delivered via openings 30 which have come into overlapping relation with first valve opening 18. This results in elevated pressure within the internal volume of cylinder 24 which acts outwards via the remaining area of openings 30 against sealing surface 22. However, unlike FIG. 2 described above, sealing surface 22 is here supported by the elevated pressure of volume 36, thereby greatly reducing or eliminating leakage between sealing surface 22 and facing surface 28 to second valve opening 20.

As will be apparent to a person having ordinary skill in the art, pressure compensation volume 36 and the aforementioned one-way valves may be implemented in many different ways without altering the fundamental concept illustrated herein. For example, it would be possible to implement manifold 10 with a third fluid flow channel (not shown) to provide fluid pressure to volume 36, and using a single set of one-way valves for the entire manifold. However, for compactness of implementation, the particularly preferred implementation illustrated here employs a miniature elastomeric valve arrangement integrated into the seal assembly of manifold 10 for each cylinder 24.

Figure 7:
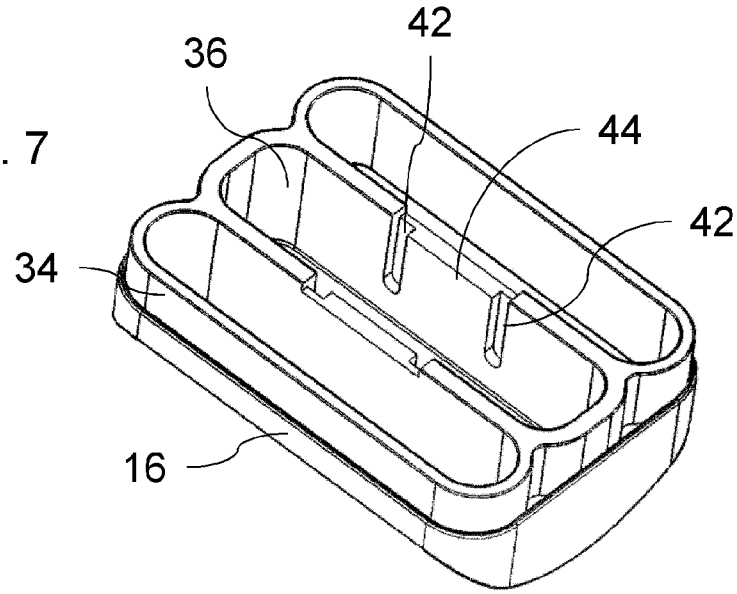
FIG. 7 is an isometric rear view of components from the valve assembly of FIG. 6.
Figure 8:
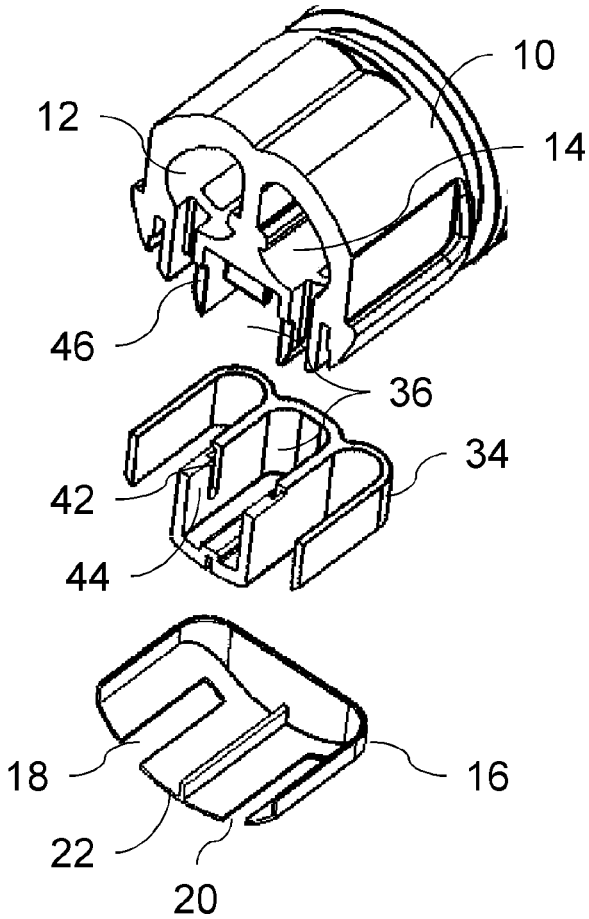
FIG. 8 is a cut-away exploded isometric view of the valve assembly of FIG. 6.

Specifically, pressure compensation volume 36 is preferably at least partially delimited by elastomer element 34 which forms at least part of the one-way valves. As best seen in FIG. 7, elastomer element 24 is formed with three separate compartments or chambers, corresponding to a feed chamber for each of valve openings 18 and 20 and pressure compensation volume 36. In the non-limiting implementation illustrated here, the walls between the chambers are preferably provided with thinned flexion regions 42 which preferably define a relatively mobile valve flap 44. In the valve assembly, valve flaps 44 are located opposite a corresponding slot 46 formed in the plastic molding of manifold 10 which surrounds elastomer element 34, thereby defining a one-way valve. Specifically, when the pressure in the adjacent feed chamber exceeds the pressure within volume 36, the water pressure acting through slot 46 displaces valve flap 44 away from the plastic molding to allow influx of water under pressure. When the pressure within volume 36 exceeds the pressure in the adjacent feed chamber, valve flap 44 is pressed against the plastic molding around slot 46, thereby sealing the slot and preventing fluid flow from escaping from volume 36.

Turning now to FIGS. 12A-15B, these illustrate a further fluid pressure driven motor generally designated 300, constructed and operative according to an embodiment of the present invention. Motor 300 is generally similar to motor 200 described above, and equivalent elements are designated by corresponding numerals. For conciseness of presentation, similar elements will not be described here again in detail. Motor 300 differs primarily from motor 200 in respect to the arrangement for providing fluid pressure to pressure compensation volume 36, as will now be described.

Figure 15A:
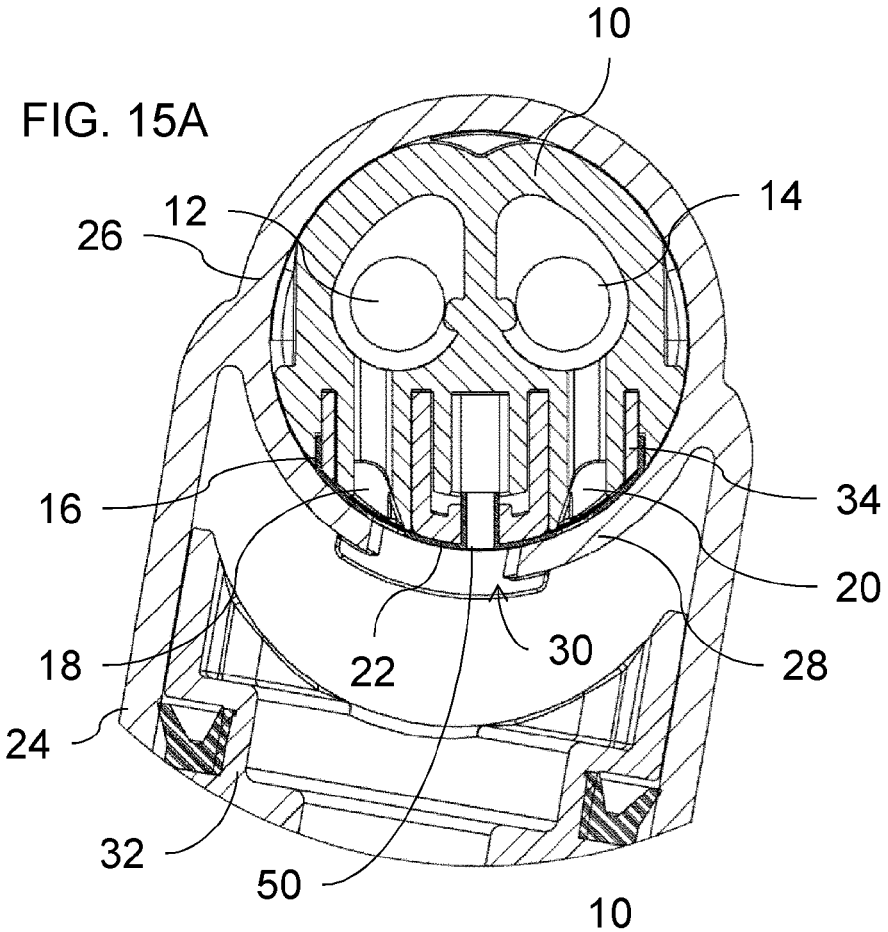
FIGS. 15A and 15B are enlarged partial cross-sectional views taken through a fluid driven motor employing the valve assembly of FIG. 12A, taken perpendicular to an extensional direction of the manifold.
Figure 15B:
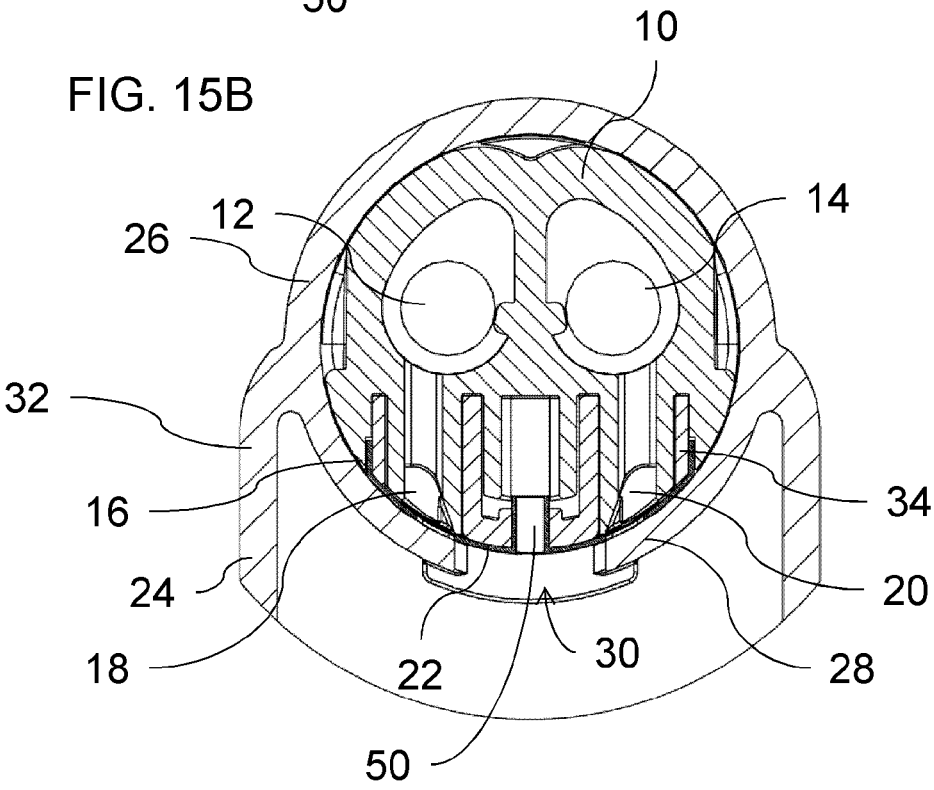

Specifically, in this case, seal 16 is here formed with a pressure equalization aperture 50 deployed to allow pressure equalization between volume 36 and the internal volume of cylinder 24. Unlike the valve based implementation of motor 200, this arrangement does not maintain volume 36 continuously at elevated pressure. However, as detailed above, the particular problem of reduced efficiency due to leakage is most problematic during the drive stroke of the piston, when the internal volume of the cylinder is under high pressure. This state is illustrated in FIG. 15A, assuming that fluid flow channel 12 is currently connected to the source of pressurized fluid and fluid flow channel 14 is connected to the drainage channel. During that part of the cycle, pressure equalization aperture 50 exposes volume 36 to the elevated pressure within the internal volume of the cylinder, thereby avoiding the net outward pressure on sealing surface 22 which has been found to result in loss of efficiency.

Elastomeric element 34 is here provided with an opening 52 to accommodate pressure equalization aperture 50, and the various features described above to form one-way valves in the embodiment of motor 200 are here omitted. In all other respects, the structure and operation of motor 300 is analogous to that of motor 200 described above.

The various embodiments of the present invention may be implemented using a wide range of materials. By way of non-limiting preferred implementations, resilient element 34 may be advantageously implemented using silicone rubber. Seal 16 is most preferably implemented using a low friction hard plastic, such as acetal resin. A suitable composition is commercially available under the trademark DELRIN® from DuPont.

It will be appreciated that the above descriptions are intended only to serve as examples, and that many other embodiments are possible within the scope of the present invention as defined in the appended claims.

What is claimed is:

1. A fluid-driven motor comprising:

(a) a manifold including a first fluid flow channel and a second fluid flow channel, said manifold providing an arcuate seal defining:

(i) a first valve opening in fluid connection with said first fluid flow channel, (ii) a second valve opening in fluid connection with said second fluid flow channel, and (iii) at least one sealing surface;

(b) a cylinder having a cylinder head mounted pivotally on said manifold, said cylinder head being providing a facing surface configured to cooperate with said arcuate seal, said facing surface having at least one aperture; and (c) a piston deployed within said cylinder so as to be driven to extend by pressure of a fluid introduced to an internal volume of said cylinder, wherein said arcuate seal and said facing surface cooperate to define a position-responsive valve configuration such that, when said cylinder assumes a neutral position, said at least one aperture is in facing relation with said at least one sealing surface, when said cylinder is angularly displaced in a first direction from said neutral position, said at least one aperture overlaps said first valve opening such that said internal volume of said cylinder is in fluid connection with said first fluid flow channel, and when said cylinder is angularly displaced in a second direction from said neutral position, said at least one aperture overlaps said second valve opening such that said internal volume of said cylinder is in fluid connection with said second fluid flow channel, wherein said manifold further comprises a pressure compensation volume underlying at least part of said at least one sealing surface, said pressure compensation volume being interconnected with at least one of said first flow channel, said second flow channel and said internal volume of said cylinder in such a manner that a pressure within said pressure compensation volume approaches a value no less than a current pressure within said internal volume.

2. The fluid-driven motor of claim 1, wherein said pressure compensation volume is interconnected via one-way valves so as to receive fluid pressure from both said first flow channel and said second flow channel.

3. The fluid-driven motor of claim 2, wherein said pressure compensation volume is at least partially delimited by an elastomer element, said elastomer element forming at least part of said one-way valves.

4. The fluid-driven motor of claim 3, wherein said elastomer element is configured to bias said seal into contact with said facing surface of said cylinder head.

5. The fluid-driven motor of claim 1, wherein said pressure compensation volume is interconnected with said internal volume of said cylinder via a pressure equalization aperture formed in said seal.

6. The fluid-driven motor of claim 1, wherein said cylinder is one of a plurality of similar cylinders, and said piston is one of a plurality of similar pistons, said pistons being connected in driving relation to a common crankshaft.

7. The fluid-driven motor of claim 1, further comprising a control valve arrangement selectively assuming:

(a) a first state in which said control valve arrangement connects said first flow channel to a source of water pressure and said second flow channel to a drainage line for driving the fluid driven motor in a first direction; and (b) a second state in which said control valve arrangement connects said second flow channel to a source of water pressure and said first flow channel to a drainage line for driving the fluid driven motor in a direction opposite to said first direction.

8. A fluid-driven motor comprising:

(a) a manifold including a first fluid flow channel and a second fluid flow channel, said manifold providing an arcuate seal defining:

(i) a first valve opening in fluid connection with said first fluid flow channel, (ii) a second valve opening in fluid connection with said second fluid flow channel, and (iii) at least one sealing surface;

(b) a cylinder having a cylinder head mounted pivotally on said manifold, said cylinder head being providing a facing surface configured to cooperate with said arcuate seal, said facing surface having at least one aperture; and (c) a piston deployed within said cylinder so as to be driven to extend by pressure of a fluid introduced to an internal volume of said cylinder, wherein said arcuate seal and said facing surface cooperate to define a position-responsive valve configuration such that, when said cylinder assumes a neutral position, said at least one aperture is in facing relation with said at least one sealing surface, when said cylinder is angularly displaced in a first direction from said neutral position, said at least one aperture overlaps said first valve opening such that said internal volume of said cylinder is in fluid connection with said first fluid flow channel, and when said cylinder is angularly displaced in a second direction from said neutral position, said at least one aperture overlaps said second valve opening such that said internal volume of said cylinder is in fluid connection with said second fluid flow channel, wherein said manifold further comprises a pressure compensation volume underlying at least part of said at least one sealing surface, said pressure compensation volume being interconnected via one-way valves so as to receive fluid pressure from both said first flow channel and said second flow channel.

9. The fluid-driven motor of claim 8, wherein said pressure compensation volume is at least partially delimited by an elastomer element, said elastomer element forming at least part of said one-way valves.

10. The fluid-driven motor of claim 9, wherein said elastomer element is configured to bias said seal into contact with said facing surface of said cylinder head.

11. A fluid-driven motor comprising:

(a) a manifold including a first fluid flow channel and a second fluid flow channel, said manifold providing an arcuate seal defining:

(i) a first valve opening in fluid connection with said first fluid flow channel, (ii) a second valve opening in fluid connection with said second fluid flow channel, and (iii) at least one sealing surface;

(b) a cylinder having a cylinder head mounted pivotally on said manifold, said cylinder head being providing a facing surface configured to cooperate with said arcuate seal, said facing surface having at least one aperture; and (c) a piston deployed within said cylinder so as to be driven to extend by pressure of a fluid introduced to an internal volume of said cylinder, wherein said arcuate seal and said facing surface cooperate to define a position-responsive valve configuration such that, when said cylinder assumes a neutral position, said at least one aperture is in facing relation with said at least one sealing surface, when said cylinder is angularly displaced in a first direction from said neutral position, said at least one aperture overlaps said first valve opening such that said internal volume of said cylinder is in fluid connection with said first fluid flow channel, and when said cylinder is angularly displaced in a second direction from said neutral position, said at least one aperture overlaps said second valve opening such that said internal volume of said cylinder is in fluid connection with said second fluid flow channel, wherein said manifold further comprises a pressure compensation volume underlying at least part of said at least one sealing surface, said pressure compensation volume being interconnected with said internal volume of said cylinder via a pressure equalization aperture formed in said seal.

* * * * *